US005626259A

United States Patent [19]

Maas et al.

[11] Patent Number: 5,626,259

[45] Date of Patent: May 6, 1997

[54] TWO LIQUID SPRAYER ASSEMBLY

[75] Inventors: Wilhelmus J. J. Maas, Someren; Petrus W. L. Hurkmans, Someren-Eind, both of Netherlands

[73] Assignee: AFA Products, Inc., Forest City, N.C.

[21] Appl. No.: 558,885

[22] Filed: Nov. 16, 1995

[51] Int. Cl.[6] ..... B67D 5/52

[52] U.S. Cl. ..... 222/136; 222/383.1

[58] Field of Search ..... 222/136, 383.1, 222/137, 144.5, 340, 341, 484

[56] References Cited

U.S. PATENT DOCUMENTS

| | | | |
|---|---|---|---|
| 4,072,252 | 2/1978 | Steyns et al. | 222/341 |
| 4,355,739 | 10/1982 | Vierkotter | 222/136 X |
| 4,365,751 | 12/1982 | Saito et al. | 222/383.1 X |
| 4,489,890 | 12/1984 | Martin | 222/383.1 X |
| 4,527,741 | 7/1985 | Garneau | 222/383.1 X |
| 4,618,077 | 10/1986 | Corsette | 222/383.1 |
| 4,747,523 | 5/1988 | Dobbs | 222/383.1 |
| 4,819,835 | 4/1989 | Tasaki | 222/383.1 |
| 5,009,342 | 4/1991 | Lawrence et al. | 222/136 |
| 5,152,461 | 10/1992 | Proctor | 222/136 X |
| 5,332,157 | 7/1994 | Proctor | 222/136 X |
| 5,370,275 | 12/1994 | Mills et al. | 222/136 |
| 5,385,270 | 1/1995 | Cataneo et al. | 222/136 X |
| 5,398,846 | 3/1995 | Corba et al. | 222/136 X |
| 5,402,916 | 4/1995 | Nottingham et al. | 222/136 X |
| 5,433,350 | 7/1995 | Graubart | 222/136 |
| 5,439,141 | 8/1995 | Clark et al. | 222/136 |
| 5,467,900 | 11/1995 | Maas et al. | 222/383.1 X |
| 5,472,119 | 12/1995 | Park et al. | 222/136 X |
| 5,535,950 | 7/1996 | Barriac et al. | 222/137 X |
| 5,560,545 | 10/1996 | Grogan et al. | 222/136 X |
| 5,562,250 | 10/1996 | O'Neill | 222/136 X |

FOREIGN PATENT DOCUMENTS 0715899 6/1996 European Pat. Off. .

*Primary Examiner*—Kevin P. Shaver
*Attorney, Agent, or Firm*—Thomas R. Vigil

[57] ABSTRACT

An apparatus for the simultaneous dispensing of two liquids from two separate liquid reservoirs at least two actuations are necessary in order for the venting of the interior and relieving of the back pressure in the liquid reservoirs. The first actuation is accomplished by rotating a valve having two mating valve members for opening and closing two sets of vertically extending passageways. The first set of passageways allows liquid to flow from the two liquid reservoirs to the intake stem of the spray pump dispenser. The second set of passageways connects both liquid reservoirs to a venting passageway. The second actuation is accomplished by pulling the trigger on the spray pump dispenser so the venting passageway is exposed to the ambient atmosphere. The venting passage reseals when the trigger returns to its rest position.

13 Claims, 8 Drawing Sheets

FIG. 3
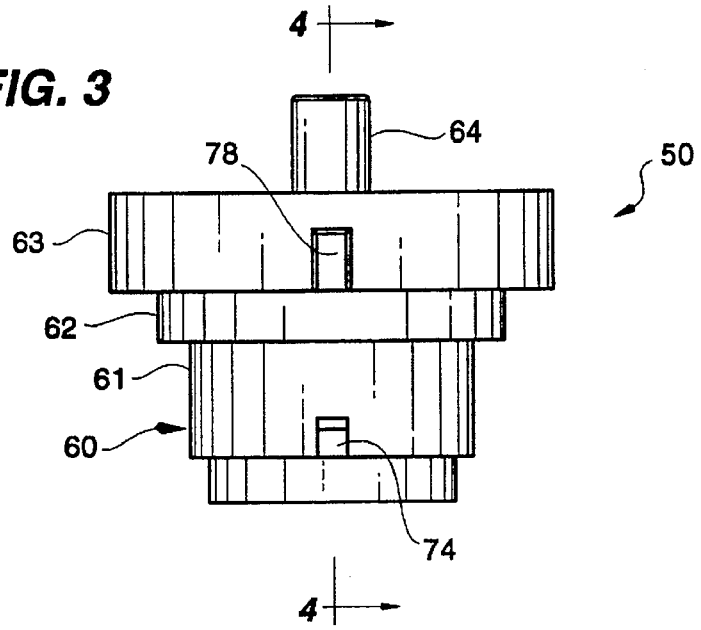
FIG. 4
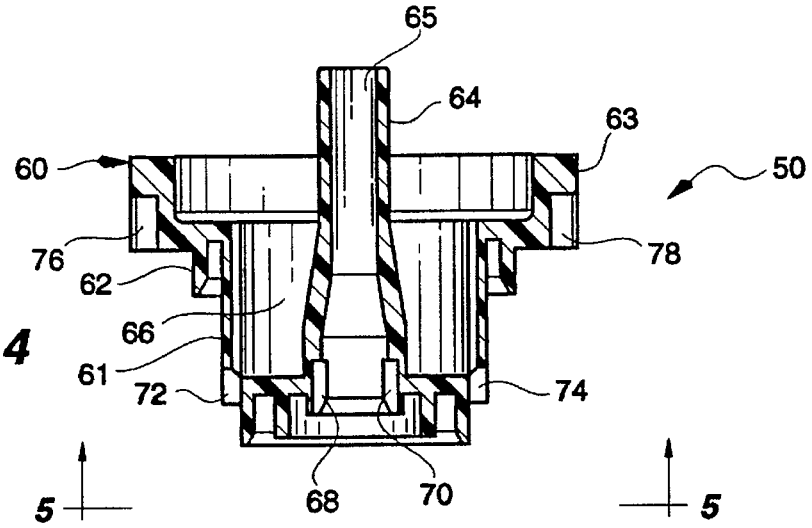
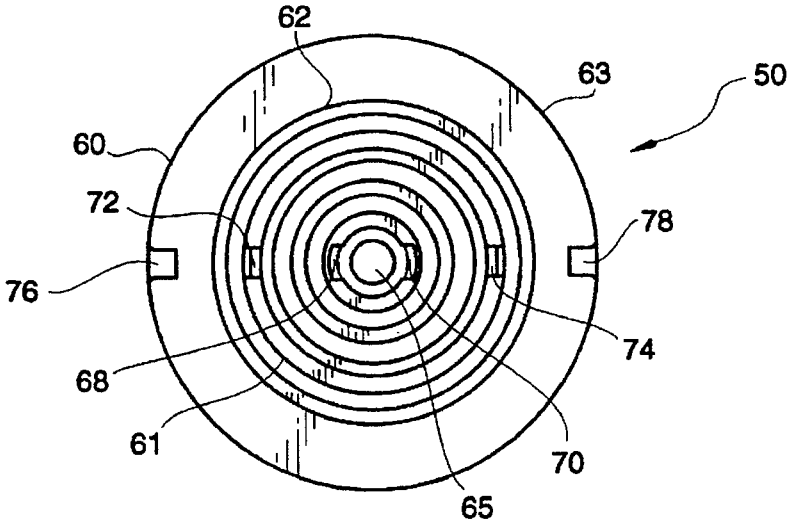
FIG. 5

FIG. 7
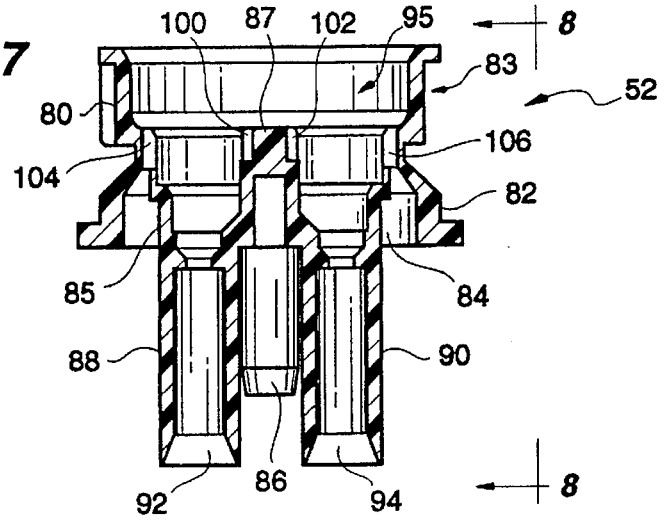
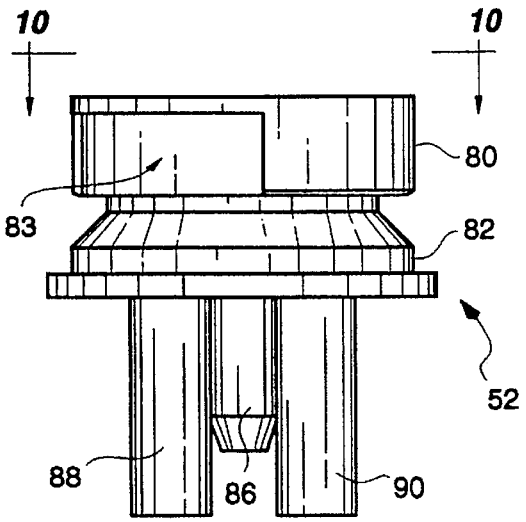
FIG. 6
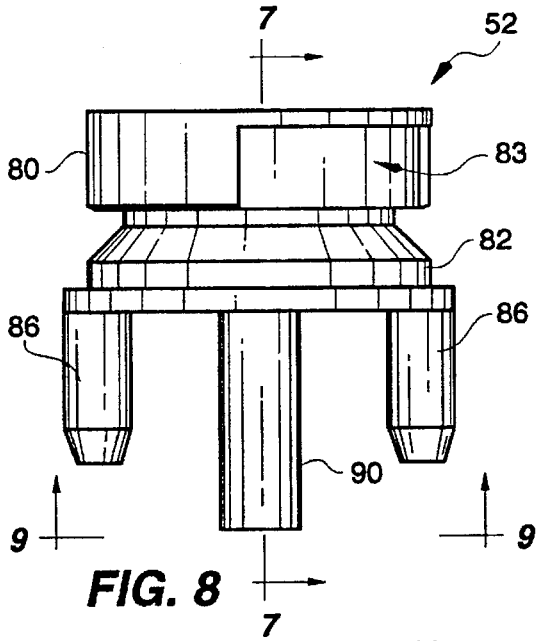
FIG. 8
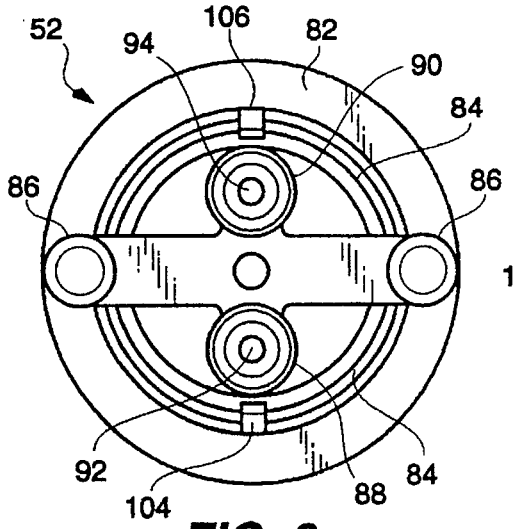
FIG. 9
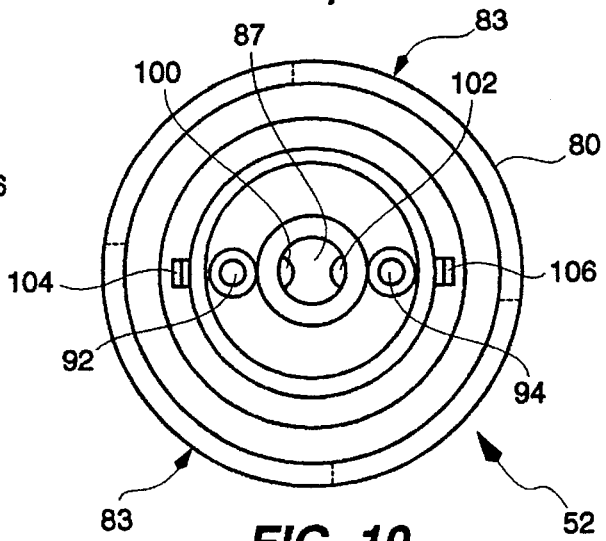
FIG. 10

FIG. 14
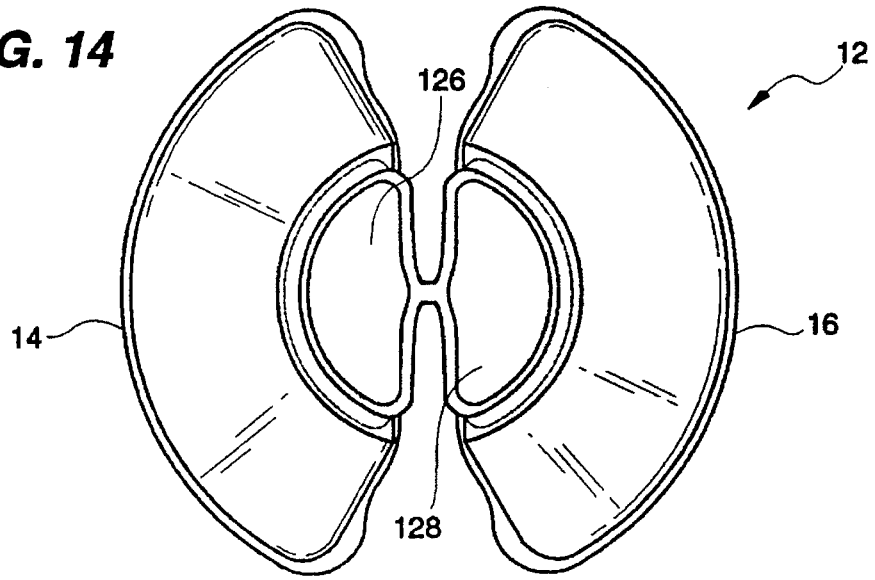
FIG. 15
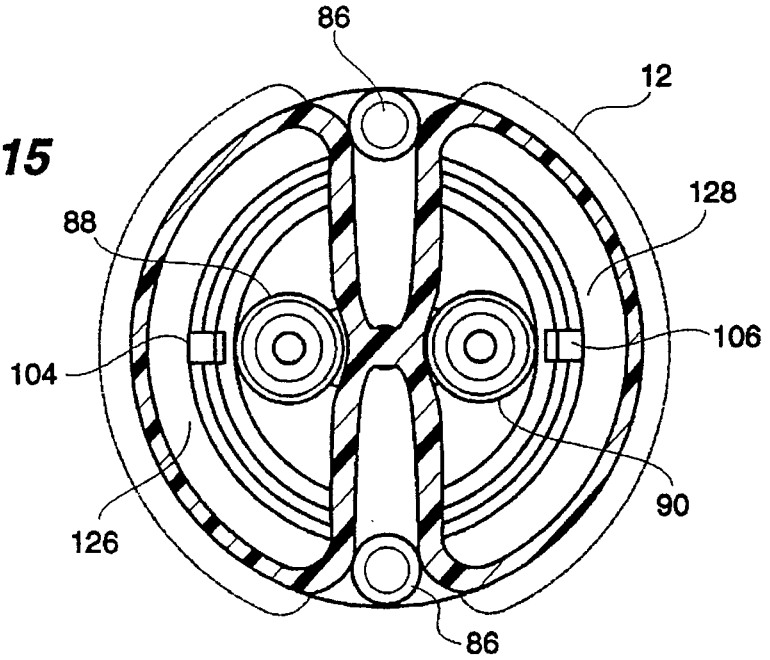
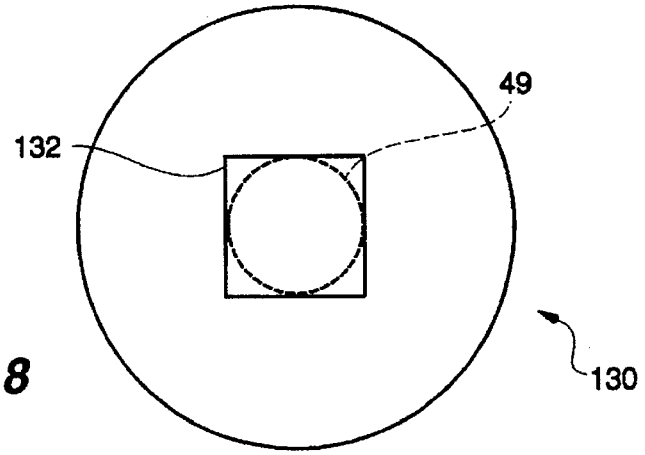
FIG. 18

TWO LIQUID SPRAYER ASSEMBLY

BACKGROUND OF THE INVENTION

1. Field of the Invention

The present invention relates to a liquid sprayer capable of simultaneously dispensing multiple liquids from multiple liquid reservoirs and having a dual action venting means for relieving back pressure in the liquid reservoirs as the liquid is dispensed while preventing leakage or evaporation of fluids.

2. Description of the Related Art Including Information Disclosed Under 37 CFR §§1.97–1.99

Heretofore, various apparatus for dispensing multiple liquids simultaneously have been proposed. Several examples of analogous and non-analogous multiple liquid sprayer assemblies are disclosed in the following U.S. Patents:

| U.S. Pat. No. | Patentee |
|---|---|
| 4,355,739 | Vierkötter |
| 5,009,342 | Lawrence et al. |
| 5,152,461 | Proctor |
| 5,398,846 | Corba et al. |
| 5,439,141 | Clark et al. |

The Vierkötter, U.S. Pat. No. 4,355,739 discloses a liquid storage container that can be connected or attached to a spray pump which comprises two separate chambers for holding liquid components. Each chamber has a liquid draw tube which leads to a mixing chamber contained within a movable member attached to a movable external selector. As the movable member is rotated the openings for transferring liquid between the two separate chambers and the spray pump overlap to a varying degree to alter the ratio at which the two liquids are mixed prior to dispensing.

The Lawrence et al., U.S. Pat. No. 5,009,342 discloses a dual liquid sprayer assembly having a spray pump dispenser, a container having at least two separate compartments, and a valve assembly located between the spray pump dispenser and the container. The valve assembly has an inner valve member and an outer valve member capable of rotating with respect to one another. The outer valve member is capable of connecting one or more of several input passageways to an output passageway connected to the pump dispenser. Each input passageway is associated with a separate fluid compartment within the container. The input passageways can be connected with a variable size opening to allow the multiple fluids to be dispensed in different ratios.

The Proctor, U.S. Pat. No. 5,152,461 discloses a trigger sprayer which selectively draws fluid out from at least two containers, mixes the fluids, and dispels the fluids out of a nozzle. The trigger sprayer is equipped with a metering device for variably controlling the ratio of the fluids being mixed. Each container is selectively detachable for refilling the container with fluid or for attaching another container having an alternate fluid.

The Corba et al., U.S. Pat. No. 5,398,846 discloses a trigger sprayer capable of simultaneous dispensing of fluids from multiple containers in a pre-determined ratio. The trigger sprayer assembly includes a valve member and a fluid transfer member between the pump sprayer and at least two fluid containers. The valve member and the fluid transfer member rotate with respect to one another for selectively connecting the fluid passageways associated with each fluid container to the intake port of the pump sprayer. The valve member and the fluid transfer member additionally instantaneously open and close venting passageways between the fluid containers and the ambient atmosphere.

The Clark et al., U.S. Pat. No. 5,439,141 discloses a manifold for use with a trigger sprayer. The manifold allows the pump sprayer to draw fluid simultaneously from two separate reservoirs containing different fluids. The manifold includes at least one ball check valve. The ball check valve prevents the pumping of fluid from one of the reservoirs when the other reservoir is empty.

Heretofore, various apparatus for relieving back pressure in the liquid reservoirs as the liquid is dispensed while preventing leakage of fluids have been proposed. Several examples of analogous and non-analogous apparatus for venting the interior of liquid reservoirs while preventing leakage of fluids are disclosed in the following U.S. Patents:

| U.S. Pat. No. | Patentee |
|---|---|
| 4,072,252 | Steyns et al. |
| 4,618,077 | Corsette |

The Steyns et al., U.S. Pat. No. 5,072,252 discloses a trigger sprayer having a plunger type pump. The plunger type pump has a piston which moves within a bore in the housing of the pump sprayer. A sealing means is located around the piston. The sealing means prevents air or liquid located behind the piston inside the trigger sprayer body from escaping into the ambient atmosphere. Air or liquid located on the other side of the sealing means is exposed to the ambient atmosphere. A venting passage has one end connected to the liquid container and a second end connected to the bore containing the piston with the sealing means. As the piston moves back and forth within the chamber, the sealing means travels over the end of the venting passage exposing the venting passage to the ambient atmosphere.

The Corsette, U.S. Pat. No. 4,618,077 discloses a trigger sprayer having a plunger type pump. The plunger type pump has a piston which moves within a bore in the housing of the pump sprayer. A sealing structure is located near the end of the piston. A venting passage provides a path between the liquid containers and the bore within the pump sprayer. When the piston is in an uncompressed position, the sealing structure prevents air or liquid located behind the sealing structure from communicating with the ambient atmosphere. As the piston moves into a compressed position within the bore, the sealing structure encounters a rib which deforms the sealing structure sufficiently to allow either liquid or air to move around the sealing structure. While the sealing structure is deformed air from the ambient atmosphere is allowed to enter the venting passage. As the piston moves into an uncompressed position the sealing structure re-establishes the seal.

SUMMARY OF THE INVENTION

According to the present invention there is provided an apparatus for the simultaneous dispensing of two liquids from two separate liquid reservoirs. The apparatus requires two actions to vent the interior of the liquid reservoirs and to relieve the back pressure in the liquid reservoirs.

The first action is accomplished by rotating a valve assembly having two mating valve members for opening and closing two sets of mating vertically registrating passageways. The first set of passageways allows liquid to flow from the two liquid reservoirs to the intake stem of the spray pump dispenser. The second set of passageways connects both liquid reservoirs to a trigger operated venting passageway.

The second action is accomplished by pulling a trigger on a spray pump dispenser to move a piston into a cylinder so that a venting passageway to the cylinder is exposed to the ambient atmosphere. The venting passage is resealed when the trigger and piston return to their rest positions.

Proper venting is very important in a two liquid sprayer to ensure that the mixture of liquids being dispelled by the trigger spray pump dispenser is kept constant. Unequal pressure change in the multiple liquid reservoirs would result in a different diminished capacity to withdraw liquid from each of the liquid reservoirs, resulting in an altered mixture ratio. It is important that all of the liquid reservoirs be allowed to vent to an equivalent pressure.

A multi-liquid dispenser is commonly used in a couple of different applications. One of the applications has one of the liquid reservoirs filled with a highly concentrated solution. The second reservoir is filled with a diluent. In some cases water may be a proper diluent. The proper dilution ratio would then be set by the configuration of the sprayer assembly and would not require the user to premix the liquids into a single liquid reservoir before spraying.

A second application has multiple fluids that when mixed together become very reactive. The liquids mixed together may be hazardous to store or may have a very short shelf life, however stored separately they may be very stable. Here it would be very desirable to only mix the amount needed just before application to a surface or area to be treated.

Because a multiple liquid sprayer is sometimes used in an environment where concentrated or reactive liquids are present, it is important for the venting passageways to self seal when the sprayer is not in use so that the concentrated or reactive liquids can not leak out or evaporate when the sprayer is not in use.

Other objects and advantages of the present application will be apparent from the detailed description and drawings which follow.

BRIEF DESCRIPTION OF THE DRAWINGS

FIG. 3 is a side view of a rotor, defining one of two valving members.

FIG. 4 is a cross sectional view of the rotor shown in FIG. 3.

FIG. 5 is a bottom view of the rotor shown in both FIGS. 3–4.

FIG. 6 is a front view of a dual intake stem defining the other one of the valving members.

FIG. 7 is a cross sectional view of the dual intake stem shown in FIG. 6.

FIG. 8 is a side view of the dual intake stem shown in FIGS. 6–7.

FIG. 9 is a bottom view of the dual intake stem shown in FIGS. 6–8.

FIG. 10 is a top view of the dual intake stem shown in FIGS. 6–9.

FIG. 14 is a top view of liquid container having dual reservoirs.

FIG. 15 is a horizontal sectional view through the dual intake stem shown in FIGS. 6–10 and the top of the liquid container shown in FIG. 14.

FIG. 18 is a plan view of a gasket located between the liquid dispensing pump and the valve assembly.

DESCRIPTION OF THE PREFERRED EMBODIMENT

Figure 1:
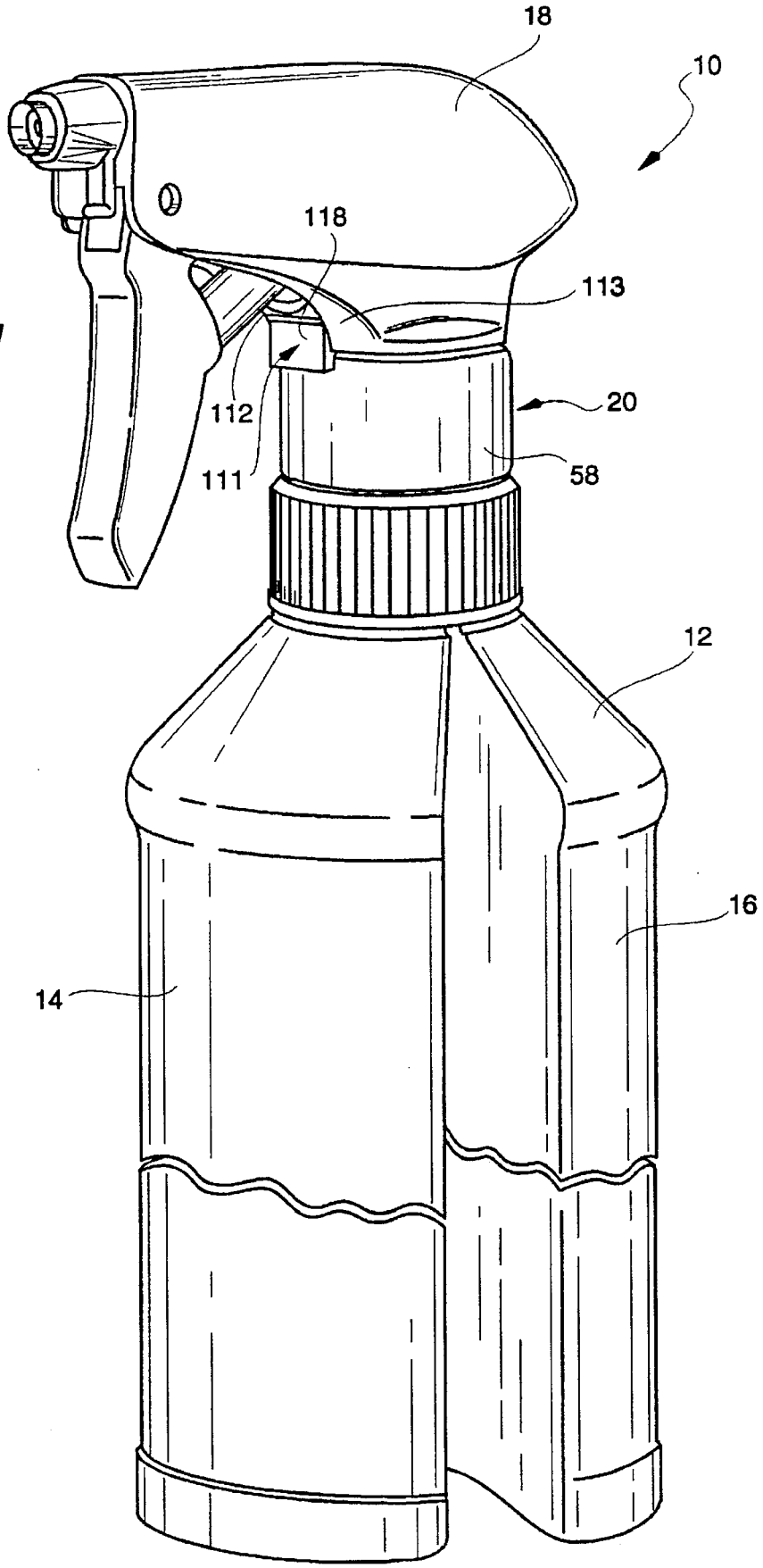
FIG. 1 is a perspective view of a trigger operated liquid sprayer capable of simultaneously dispensing multiple liquids from multiple liquid reservoirs.

Referring now to the drawings in greater detail, there is illustrated in FIG. 1 a dual liquid sprayer assembly 10 capable of simultaneously dispensing multiple liquids from multiple liquid reservoirs. The dual liquid sprayer assembly 10 includes a container 12 having multiple liquid reservoirs. In the embodiment shown, there are two liquid reservoirs 14 and 16. The dual liquid sprayer assembly 10 additionally includes a trigger operated liquid dispensing pump 18 and a valve assembly 20. The inner workings of the liquid dispensing pump 18 and the valve assembly 20 are shown in greater detail in FIG. 2. and other subsequent figures.

Figure 2:
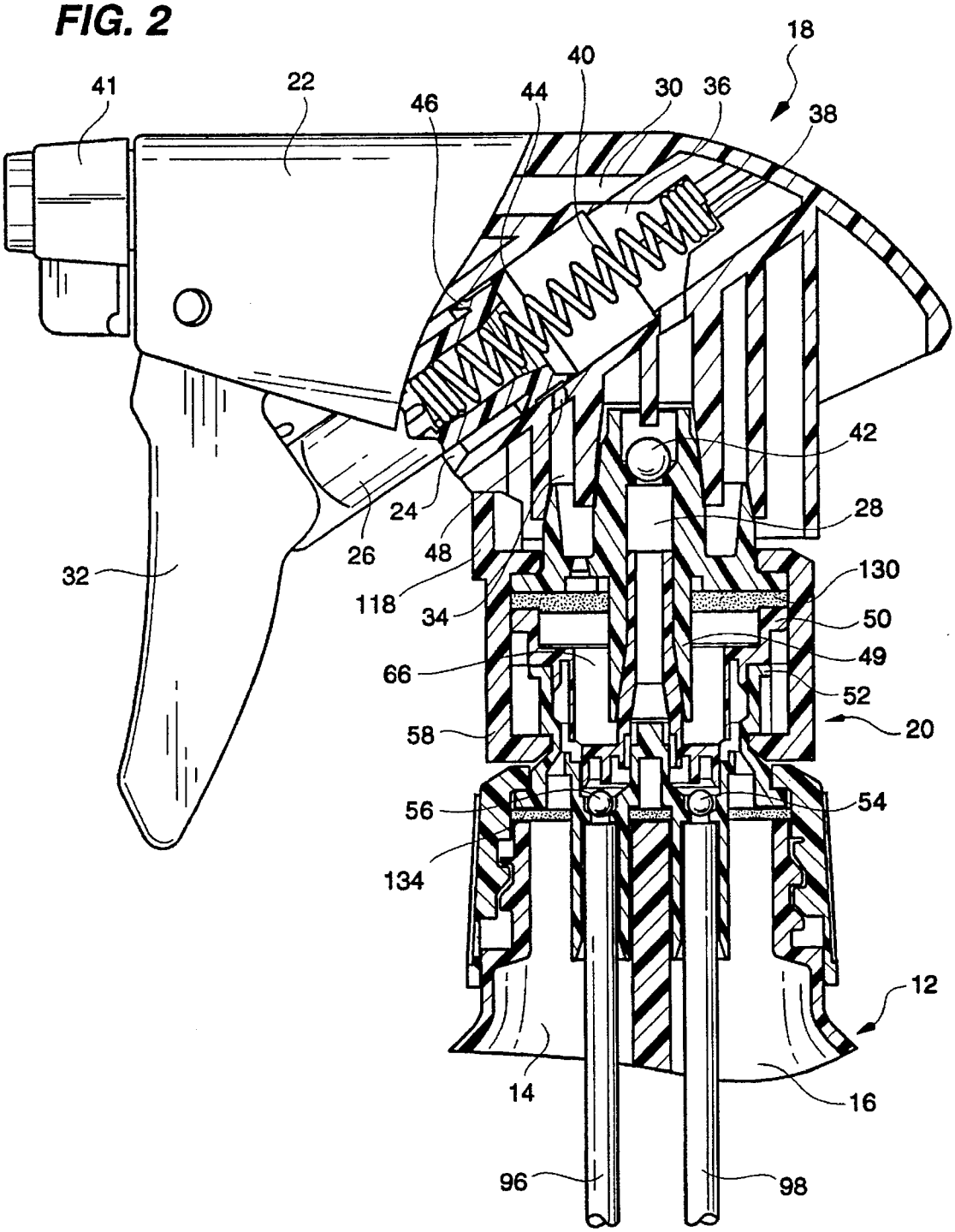
FIG. 2 is an enlarged, cross sectional view of the liquid dispensing pump and the valve assembly of the liquid sprayer shown in FIG. 1 with portion cut away.

FIG. 2 is partial cut-away cross sectional drawing of the liquid dispensing pump 18 and the valve assembly 20. The liquid dispensing pump includes a pump body 22 having an outwardly opening bore 24, a piston 26, an inlet port 28, an outlet port 30, a manually actuated trigger 32, and a venting path 34. The piston 26 defines a variable sized compartment 36 within the bore 24 between the piston 26 and the back wall 38 of the bore 24.

The piston 26 is coupled to the manually actuated trigger 32. As the trigger 32 is pressed causing the trigger 32 to pivot inward, the piston 26 is moved along the outwardly opening bore 24 into a compressed position. As the piston 26 is moved into a liquid compressing position and the variable sized compartment 36 shrinks to its smallest size. A spring 40 is located between the piston 26 and the back wall 38 of the bore 24. When the user releases the trigger 32, the spring 40 pushes the trigger 32 and piston 26 into their rest positions. When the piston 26 is in its rest position the variable sized compartment 36 is at its largest size.

As the variable sized compartment expands, liquid is drawn into the liquid dispensing pump 18 through the inlet port 28. As the variable sized compartment shrinks, the liquid inside the liquid dispensing pump 18 is expelled through the outlet port 30 and ultimately out through the nozzle 41. A ball valve 42 prevents the liquid inside the liquid dispensing pump 18 from being expelled through the inlet port 28.

The piston additionally has a sealing structure in the form of spaced apart lips or ridges 44 and 46 located around the circumference of the piston 26. One of the ridges 44 is located such that the ridge 44 is always between the opening 48 of the venting path 34 and the variable sized chamber 36. The other ridge 46 is located such that when the piston 26 is in a rest position the ridge 46 is located between the opening 48 of the venting path 34 and the open end of the bore 24. As the piston 26 is pushed into the bore 24 by the trigger 32, the ridge 46 travels over the opening 48 of the venting path 34 such that when the piston 26 is in a compressed position the opening 48 of the venting path 34 is exposed to the open end of the bore 24 and the ambient atmosphere.

The inlet port 28 ends in a tube shaped structure called a fluid intake stem 49. The fluid intake stem 49 extends below the rest of the trigger operated liquid dispensing pump 18 and has a cross-section that is circular in shape.

The valve assembly 20 includes two valve members, namely a rotor 50 and a dual intake stem 52, two ball valves 54 and 56 and a fix shell 58. The two valve members 50 and 52 fit together and rotate with respect to one another.

The first valve member or rotor 50 shown in FIGS. 3–5 is generally cylindrically symmetrical, with the exception of three sets of notches. The outer wall 60 of the rotor 50 has three stepped annular wall surfaces 61, 62 and 63 and the circumference of the outer wall 60 increases at discrete points along the wall from bottom wall surface 61 to a top wall surface 63. A central tube-like structure 64, forming a central passageway 65, extends from the bottom of the rotor 50 to beyond the top of the outer wall 60. The central passageway 65 forms part of a liquid transfer passageway between the liquid container 12 and the liquid dispensing pump 18. A chamber 66 is formed between the outer wall 60 and the tube-like structure 64. The chamber 66 forms part of a venting passageway be%ween the liquid container 12 and the liquid dispensing pump 18.

A first set of notches 68 and 70 is located inside and at the bottom of the central passageway 65. A second set of notches 72 and 74 is located in the outer wall 61 extending outwardly of the chamber 66 and in communication with the chamber 66. A third set of notches 76 and 78 is located in the outer wall 63 at the bottom corner of the portion of the outer wall surface 63 having the largest circumference.

The third set of notches 76 and 78 as discussed below serve to rotationally fix the rotor 50 with respect to the fix shell 58. While the preferred embodiment illustrated in the drawings make use of two notches 76 and 78, one skilled in the art can appreciate that their intended function could be performed with one or more notches.

The second valve member or dual intake stem 52 shown in FIGS. 6–10 has a top annular wall 80. Around and depending outwardly from the top annular wall 80 is a cylindrical skirt 82. A space 84 is defined between the skirt 82 and a downwardly extending short cylindrical portion 85. Above the cylindrical skirt 82 around the outside of the top annular wall 80 are two identical regions 83 located on opposite sides of the top annular wall 80 and extending approximately one quarter of the way around the outer circumference of the top annular wall 80. Protruding downwardly from a bottom of the short cylindrical portion 85 are two rod shaped fingers 86. Extending up from the center of the short cylindrical portion 85 a center stem 87.

Two cylindrical tubes 88 and 90 extend below the short cylindrical portion 85 on each side of the stem 87. Each of the cylindrical tubes 88 and 90 is hollow, having a central passageway 92 and 94. One end of each of the central passageways 92 and 94 opens up into a space 95 within the top annular wall 80. The other end of each of the two cylindrical tubes 88 and 90 is coupled to a separate dip tube 96 and 98 (FIG. 2). Each dip tube 96 and 98 (FIG. 2) extends into one of the liquid reservoirs 14 and 16.

The dual intake stem 52 further includes two sets of notches. The first set of notches 100 and 102 are cut into the top of the center stem 87 and open respectively onto one of the passageways 92, 94 at the side and into the space 95 at the top of each notch 100, 102. The second set of notches 104 and 106 are located inside the cylindrical skirt 82 and open at the bottom into the space 84 between the cylindrical skirt 82 and the short cylindrical portion 85, at the top into the space 95 and at one side onto one of the passageways 92 and 94.

Figure 11:
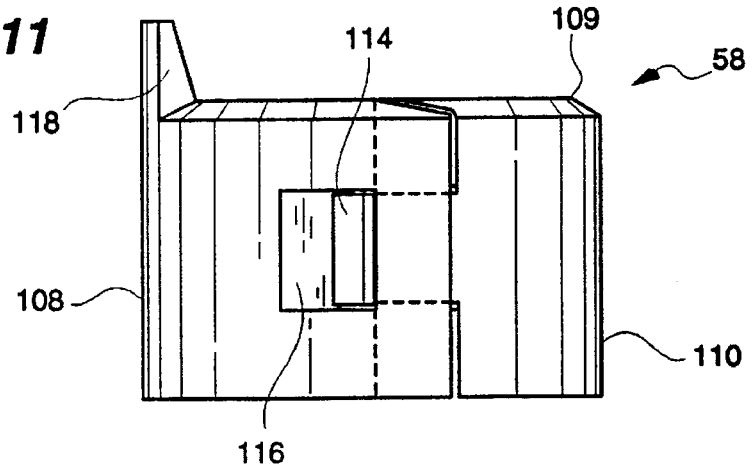
FIG. 11 is a side view of a fix shell which partially encases the valve assembly.
Figure 12:
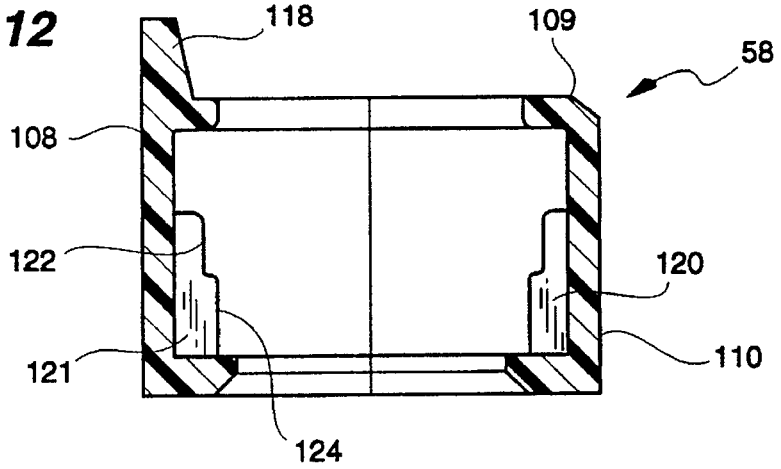
FIG. 12 is a cross sectional view of the fix shell shown in FIG. 11.
Figure 13:
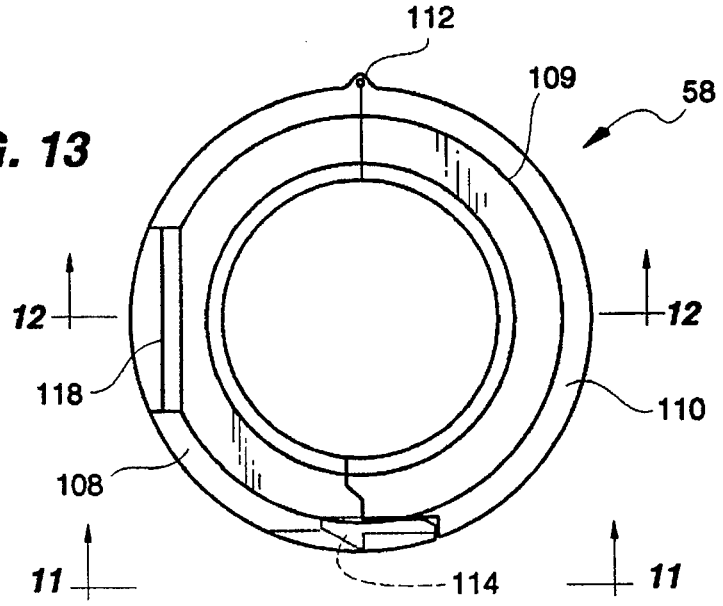
FIG. 13 is the top view of the fix shell shown in FIG. 11.

The fix shell 58 shown in FIGS. 11–13 includes two pieces, a left side piece 108 and a right side piece 110, each shaped as half of a hollow cylinder. The two pieces are connected by a short connecting segment 112 which acts as a living hinge and allows the two pieces to move together to form a complete cylinder. The right side piece 110 on the side opposite the short connecting segment 112 includes a hook 114 for engaging a clasp 116 located on the left side piece 108. The clasp 116 is located on a side opposite the short connecting segment 112.

Along a top ridge 109 and approximately centered along the right side piece 108 is a fin 118. When the fix shell 58 is clasped around the two valve members 50 and 52, the fin 118 is located in a gap 111 located between side walls 112 and 113 (FIG. 1) of the pump body 22 below the outwardly opening bore 24. The fin 118 prevents the fix shell 58 from altering its rotational alignment with respect to the trigger operated liquid dispensing pump 18.

Near the center of both the left side piece 108 and the right side piece 110 on the inside of the half cylindrical pieces are two flanges 120 and 121, with one of the flanges 121 associated with the left side piece 108 and the other flange 120 associated with the right side piece 110. Each flange 120 and 121 has an upper portion 122 and a lower portion 124. Each portion 122 and 124 extends toward the center of the fix shell 58 to two different depths, with the lower portion 124 of each flange 120 and 121 extending the greater of the two depths.

The upper portion 122 of each flange 120 and 121 engages one of the notches 76 and 78 of the third set of notches of the rotor 50. The mated upper portion 122 of each flange 120 and 121 and the notches 76 and 78 of the rotor 50 prevent the rotor 50 from rotating with respect to the fix shell 58 and indirectly with respect to the liquid dispensing pump 18.

The lower portion 124 of each flange 120 and 121 extends into one of the two cut-away regions 83 of the dual intake stem 52 preventing the dual intake stem from rotating greater than approximately a quarter turn, the arcuate length of each of the two cut-away regions 83.

A top view of the container 12 having two liquid reservoirs 14 and 16 is shown in FIG. 14. The container 12 has two openings 126 and 128, one for each of the liquid reservoirs 14 and 16.

FIG. 15 shows the two openings 126 and 128 of the container 12 mated with the dual intake stem 52. Each one of the two cylindrical tubes 88 and 90 of the dual intake stem 52 extends down into one of the openings 126 and 128 of the two liquid reservoirs 14 and 16. The fingers 86 of the dual intake stem 52 extend down between the openings 126 and 128 of the two liquid reservoirs 14 and 16. The fingers 86 serve to rotationally fix the dual intake stem with respect to the container 12.

Figure 19:
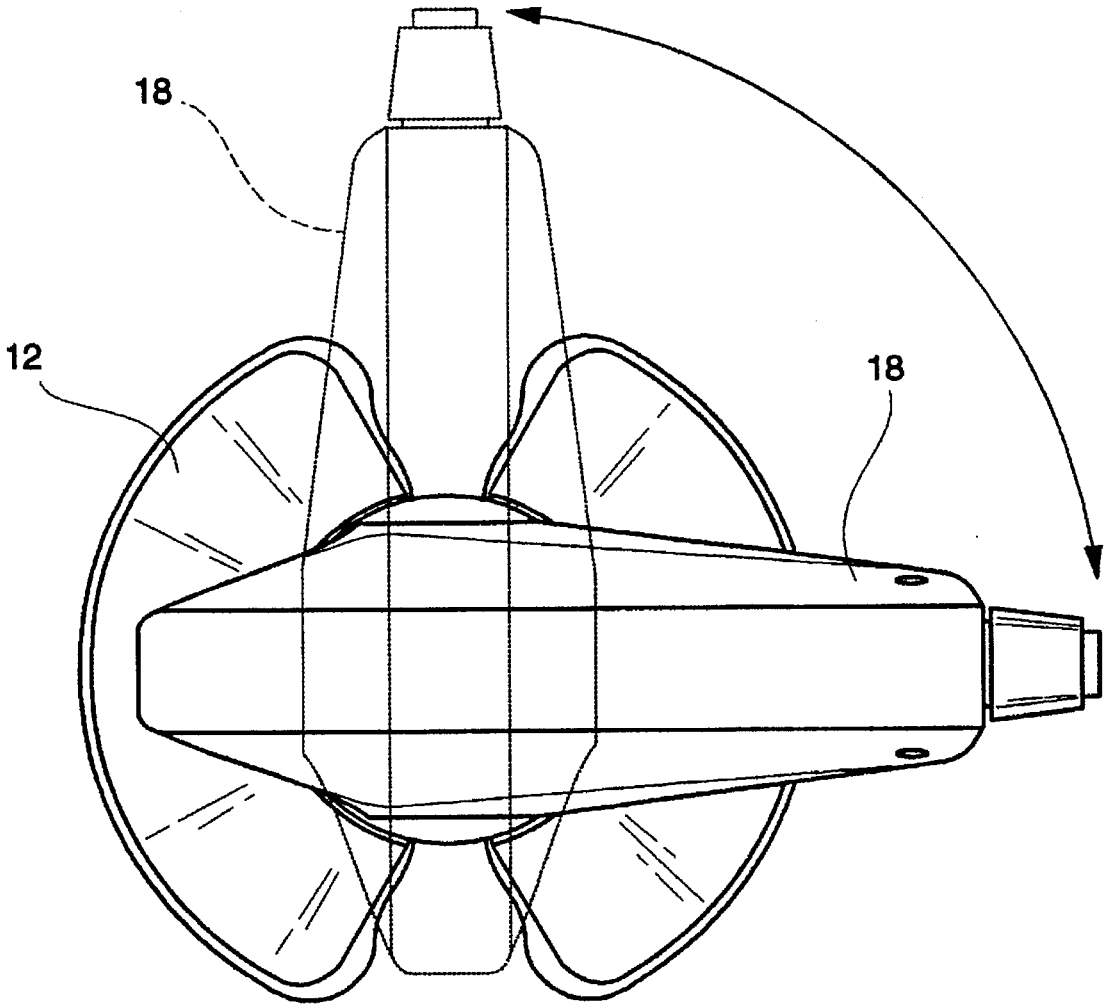
FIG. 19 is a top view of the trigger operated liquid sprayer showing the liquid dispensing pump in an unrotated position and shown in phantom lines the liquid dispensing pump rotated 90°.

As already described above, the dual intake stem 52 is rotationally fixed with respect to the container 12. Similarly, as described above, the rotor 50 is rotationally fixed to the liquid dispensing pump 18 via the fix shell 58. As a result the two valve members, the rotor 50 and the dual intake stem 52, can be rotated with respect to one another by rotating the liquid dispensing pump 18 with respect to the container 12. The liquid dispensing pump, as shown in FIG. 19, can be rotated from a first position a quarter turn to a second position with respect to the container 12 to rotate the mating valve members with respect to one another. In order to return the valve members to their original orientation with respect to one another, the liquid dispensing pump is rotated back in the opposite direction to the first position.

As the two valve members are rotated with respect to one another the liquid passageways and the venting passageways through the valve assembly 20 are opened and closed.

Figure 16:
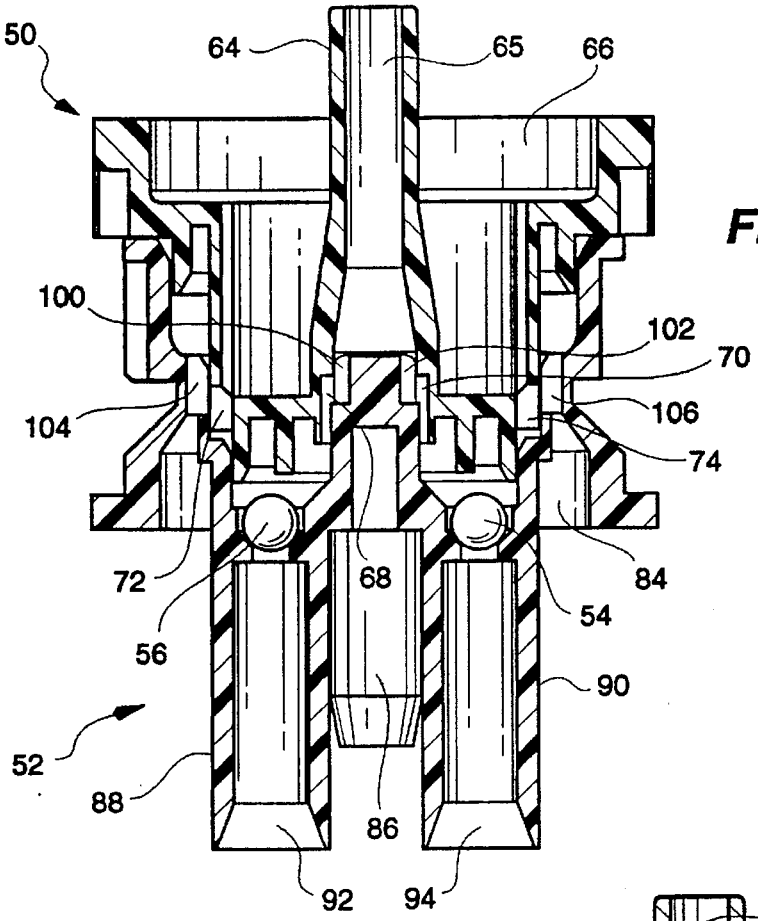
FIG. 16 is a vertical cross-sectional view of the rotor shown in FIGS. 3–5 in combination with the dual intake stem shown in FIGS. 6–10 rotationally aligned to allow liquids and air to flow through the valve assembly.
Figure 17:
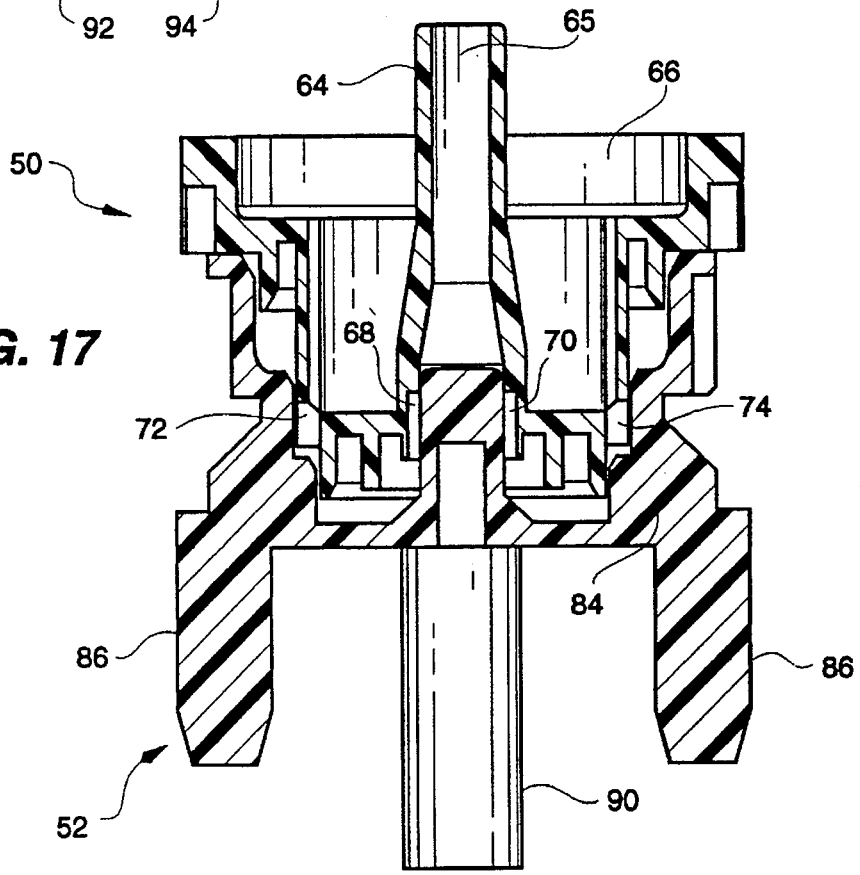
FIG. 17 is a sectional cross-sectional view of the rotor shown in FIGS. 3–5 in combination with the dual intake stem shown in FIGS. 6–10 rotationally aligned to prevent liquids and air from flowing through the valve assembly.

FIGS. 16 and 17 show the two valve members, the rotor 50 and the dual intake stem 52, together. FIG. 17 shows the rotor 50 and the dual intake stem 52 having been rotated a quarter turn with respect to one another and their position, as shown in FIG. 16, shows the rotational orientation of the valve members 50 and 52 when the liquid transfer and venting passageways are opened extending vertically through the valve assembly 20.

FIG. 17 shows the rotational orientation of the valve members 50 and 52 when the liquid transfer and venting passageways are closed through the valve assembly 20.

FIG. 16 shows the rotational orientation of the valve members 50 and 52 when the liquid transfer and venting passageways are opened through the valve assembly 20. The liquid transfer passageway and the venting passageways are opened by bringing the notches 68, 70 of the rotor 50 into vertical registration with notches 100, 102 of the dual intake stem 52 and notches 72, 74 of the rotor 50 into vertical registration with notches 104, 106 of the dual intake stem 52.

When the valve members 50 and 52 are rotationally aligned as shown in FIG. 16, liquid can enter the cylindrical tubes 88 and 90 of the dual intake stem 52 pass through the ball valves 56 and 54, pass in the space between the first set of notches 68 and 70 of the rotor 50 and the first set of notches 100 and 102 of the dual intake stem 52, and into the central passageway 65 of the tube like structure 64 of the rotor 50.

Similarly air can pass from the chamber 66 formed between the outer wall 60 and the tube-like structure 64 of the rotor 50, through space between the second set of notches 72 and 74 of the rotor 50 and the second set of notches 104 and 106 of the dual intake stem 52, and into the space 84 between the cylindrical skirt 82 and the cylindrical top portion 80 of the dual intake stem 52.

FIG. 17 shows the rotational orientation of the valve members 50 and 52 where the liquid transfer and venting passageways are closed through the valve assembly 20. The liquid transfer and venting passageways are closed by bringing the sets of notches associated with each valving member out of alignment.

When the valve members 50 and 52 are rotationally aligned as shown in FIG. 17, liquid is prevented from passing from the cylindrical tubes 88 and 90 of the dual intake stem 52 to the central passageway 65 of the tube like structure 64 of the rotor 50 as there is no longer any space between the first set of notches 68 and 70 of the rotor 50 and the first set of notches 100 and 102 of the dual intake stem 52.

Similarly air is prevented from passing from the chamber 66 formed between the outer wall 60 and the tube-like structure 64 of the rotor 50 into the space 84 between the cylindrical skirt 82 and the cylindrical top portion 80 of the dual intake stem 52 as there is no longer any space between the second set of notches 72 and 74 of the rotor 50 and the second set of notches 104 and 106 of the dual intake stem 52.

In FIG. 18 is shown a gasket 130 which fits between the valve assembly 20 and the liquid dispensing pump 18. The gasket 130 includes a square hole 132 through which the fluid intake stem 49 of the liquid dispensing pump 18 passes. The space between the corners of the square hole 132 and the circular fluid intake stem 49 allows air to pass from the venting path 34 in the liquid dispensing pump 18 to the chamber 66 of the rotor 50.

A second gasket 134, shown in FIG. 2, is located between the dual intake stem 52 and the container 12. The gasket 134 includes two holes through which the cylindrical tubes 88 and 90 of the dual intake stem 52 pass. Similar to gasket 130, the holes in the gasket 134 are larger than the cylindrical tubes 88 and 90 of the dual intake stem 52 allowing air to pass from the space 84 between the cylindrical skirt 82 and the cylindrical top portion 80 of the dual intake stem 52 into the two liquid reservoirs 14 and 16 of the container 12.

From the foregoing description, it will be apparent that the dual liquid sprayer assembly 10 of the present invention has a number of advantages, some of which have been described above and others of which are inherent in the invention. Also it will be understood that modifications can be made to the two liquid sprayer assembly described above without departing from the teachings of the invention.

I claim:

1. An apparatus for simultaneously dispensing multiple liquids comprising:

a container having two liquid reservoirs, each reservoir being capable of storing a separate liquid;

a trigger operated liquid dispensing pump including a pump body having an outwardly opening bore, a piston having a peripheral sealing means which traverses along said bore, said piston defining a variable sized compartment within said bore, an inlet port and an outlet port for delivering liquid into and out of the variable sized compartment, a manually actuated trigger coupled to said piston for causing said piston to traverse from a non-pumping position to a pumping position within said bore as said trigger is actuated, and a venting path extending through said pump body and opening at one end into the bore at a point along the path of travel of said sealing means of said piston when said manually actuated trigger is actuated and, when said sealing means of said piston is in a non-pumping position, said venting path is prevented from communicating with the ambient atmosphere by said sealing means and when said piston is moved to a pumping position, said venting path is permitted to communicate with the ambient atmosphere; and a valve assembly for opening and closing a first and a second set of passageways, said first set of passageways comprising a plurality of liquid transfer passageways, each liquid transfer passageway for transferring fluid from one of said liquid reservoir to said inlet port of said liquid dispensing pump, said second set of passageways comprising a plurality of venting passageways, each venting passageway for coupling a liquid reservoir to said venting path of said liquid dispensing pump.

2. An apparatus for simultaneously dispensing multiple liquids according to claim 1 wherein said sealing means is located circumferentially about the piston.

3. An apparatus for simultaneously dispensing multiple liquids according to claim 2 wherein said piston further has a second sealing means located between the venting path opening into the bore and said variable sized compartment.

4. An apparatus for simultaneously dispensing multiple liquids according to claim 1 wherein said liquid dispensing pump further includes resilient means for pushing the piston into said non-pumping position.

5. An apparatus for simultaneously dispensing multiple liquids according to claim 1 wherein said valve assembly further includes a first valve member and a second valve member.

6. An apparatus for simultaneously dispensing multiple liquids according to claim 5 wherein said first and second valve members each include a part of said first and second set of passageways.

7. An apparatus for simultaneously dispensing multiple liquids according to claim 6 wherein said first and second valve members rotate with respect to one another to bring into and out of alignment said parts of said first and second passageways associated with each valve member.

8. An apparatus for simultaneously dispensing multiple liquids according to claim 7 wherein said first valve member is rotationally fixed with respect to said liquid dispensing pump.

9. An apparatus for simultaneously dispensing multiple liquids according to claim 7 wherein said second valve member is rotationally fixed with respect to said container having said two liquid reservoirs.

10. An apparatus for simultaneously dispensing multiple liquids according to claim 7 wherein said first and second valve members rotate 90° with respect to one another to bring into and out of alignment said parts of said first and second passageways associated with each valve member.

11. An apparatus for simultaneously dispensing multiple liquids according to claim 7 wherein said first valve member is rotationally fixed with respect to said liquid dispensing pump and said second valve member is rotationally fixed with respect to said container having same two liquid reservoirs, and said first and second valve members are rotated with respect to one another by turning said liquid dispensing pump with respect to said fluid container.

12. An apparatus for simultaneously dispensing multiple liquids according to claim 1 wherein said liquid transfer passageways extend through said valve assembly in a vertical direction.

13. An apparatus for simultaneously dispensing multiple liquids according to claim 1 wherein said venting passageways extend through said valve assembly in a vertical direction.

* * * * *